US006920975B1

(12) United States Patent
Salander et al.

(10) Patent No.: US 6,920,975 B1
(45) Date of Patent: Jul. 26, 2005

(54) CLOCK FOR NOTEPAD COVER FLAP

(75) Inventors: Mark T. Salander, Barrington, RI (US); Agnes Csilla Domotor, Jamaica Plain, MA (US); Joshua B. Lederer, Brookline, MA (US)

(73) Assignee: The Gem Group, Lawrence, MA (US)

( * ) Notice: Subject to any disclaimer, the term of this patent is extended or adjusted under 35 U.S.C. 154(b) by 0 days.

(21) Appl. No.: 10/448,159

(22) Filed: May 29, 2003

(51) Int. Cl.[7] ..... B65D 85/00

(52) U.S. Cl. ..... 206/215; 206/232; 40/728; 368/278

(58) Field of Search ..... 206/215, 472, 206/473, 459.1, 232; 281/29, 31, 15.1, 51; 40/606.03, 728, 124.01; 368/45, 278, 283, 368/295; D19/88

(56) References Cited

U.S. PATENT DOCUMENTS 3,700,148 A * 10/1972 Lanvin ..... 224/170
4,682,310 A * 7/1987 Lund et al. ..... 368/278
4,705,408 A * 11/1987 Jordi ..... 368/278
4,892,334 A * 1/1990 Sinclair ..... 281/45
5,030,027 A * 7/1991 Bachrach et al. ..... 402/4
5,163,748 A * 11/1992 Messinger ..... 362/98
5,180,133 A * 1/1993 Chang ..... 248/452
5,232,301 A * 8/1993 Bianco ..... 402/73
D353,399 S * 12/1994 Dodge ..... D19/88
5,413,382 A * 5/1995 Cornell et al. ..... 281/45
5,732,925 A * 3/1998 Shamoon ..... 248/452
6,241,360 B1 * 6/2001 Merrell ..... 362/99

* cited by examiner

*Primary Examiner*—Jacob K. Ackun
*Assistant Examiner*—Jamila Williams
(74) *Attorney, Agent, or Firm*—Cesari and McKenna, LLP; William A. Loginov

(57) ABSTRACT

A digital clock mounted within a flap overlying the spine of a notepad on a notepad cover is provided. A raised bezel or surround constructed from a soft, pliable material, such as soft polyvinylchloride (PVC), covers a portion of the clock chip, exposing its digital readout. Detents or holes may be provided for inserting pens or other blunt instruments for setting the clock. A port is provided in the flap to access the underside of the clock chip, and can be covered, along the underside of the flap, with a piece of elastic material. By moving the elastic material aside, access to the battery of the clock chip is provided.

17 Claims, 4 Drawing Sheets

CLOCK FOR NOTEPAD COVER FLAP

BACKGROUND OF THE INVENTION

1. Field of the Invention

This invention relates to business accessories and more particularly to notepad covers or holders.

2. Background Information

Notepad covers or holders are a common and widely used business accessory. In general, a notepad cover consists of a front and a back cover between which is placed a notepad. The front and back cover may be padded and covered with a decorative material such as leather. Typically, the interior of the back cover includes a large pocket into which the cardboard back of the notepad is slipped, while the interior of the front cover may include a variety of pockets and windows for holding cards, loose papers, pens and other items. Particular decorative versions of notepad covers may include a flap over the spine of the pad. The flap covers the often-unaesthetic spine. As consumer electronics devices become continually smaller, electronic features, such as calculators have been provided either integrally or removably to notepads and other business accessories. The flap provides a convenient and readily visible space for such an accessory.

SUMMARY OF THE INVENTION

This invention provides a digital clock mounted within a flap overlying the spine of a notepad on a notepad cover. A raised bezel or surround constructed from a soft, pliable material, such as soft polyvinylchloride (PVC), covers a portion of the clock chip, exposing its digital readout. Detents or holes may be provided for inserting pens or other blunt instruments for setting the clock. A port is provided in the flap to access the underside of the clock chip, and can be covered, along the underside of the flap, with a piece of elastic material. By moving the elastic material aside, access to the battery of the clock chip is provided.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
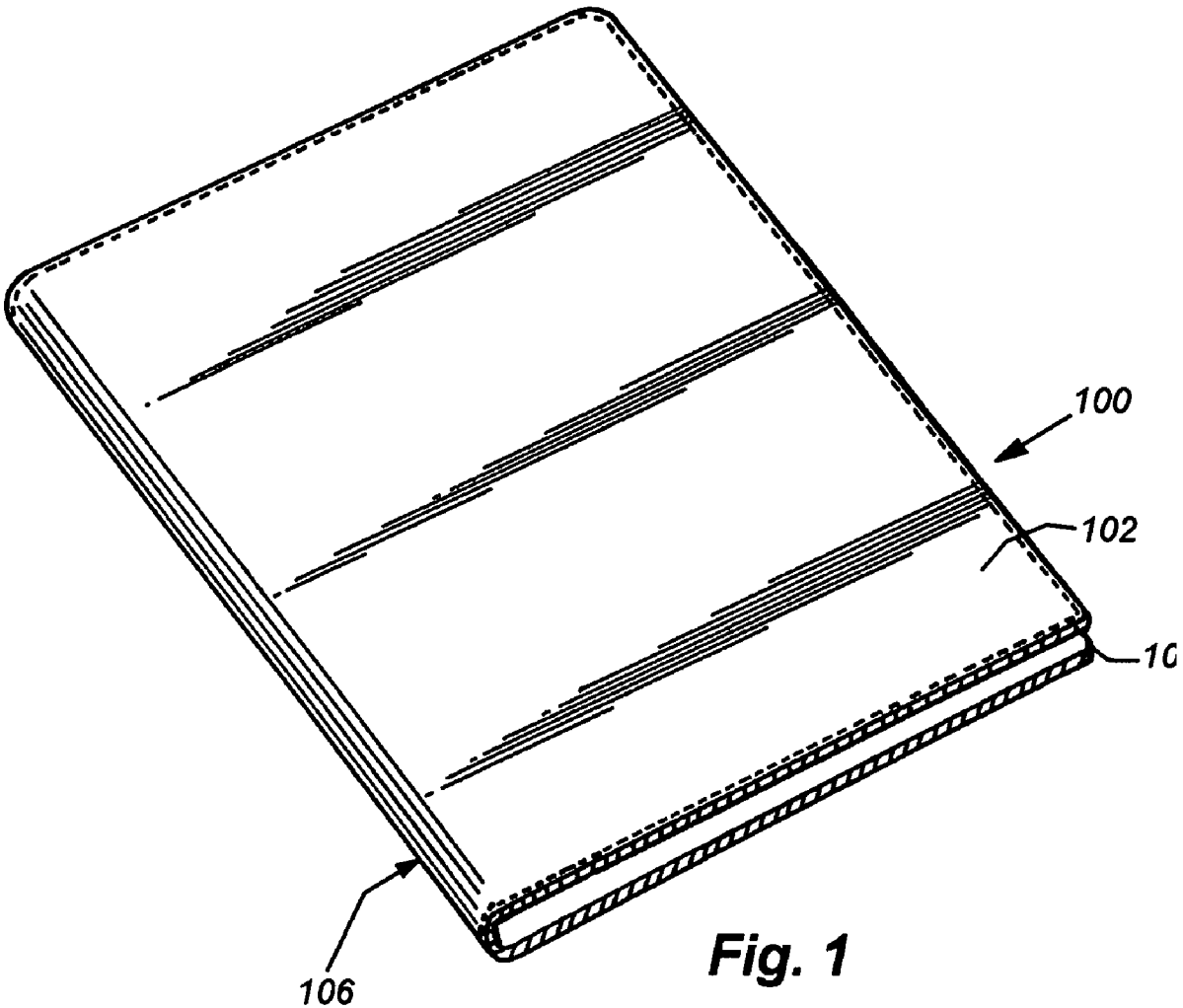
FIG. 1 is an isometric view of a notepad cover in a closed position.

A notepad cover 100 according to an illustrative embodiment of this invention is shown in FIG. 1 in a closed position. The notepad cover includes a top (or front) cover 102 and a bottom (or back) cover 104. A spine 106 joins the covers. The dimensions of the notepad cover generally conform to those of an average notepad. In other words, they are slightly larger than 8½×11 inches or 8½×14 inches.

They can also be sized to accommodate a metric-standard pad such as A4-size. The covers can be provided with a variety of optional exterior features including pockets, seam details and decorative stitching.

Figure 2:
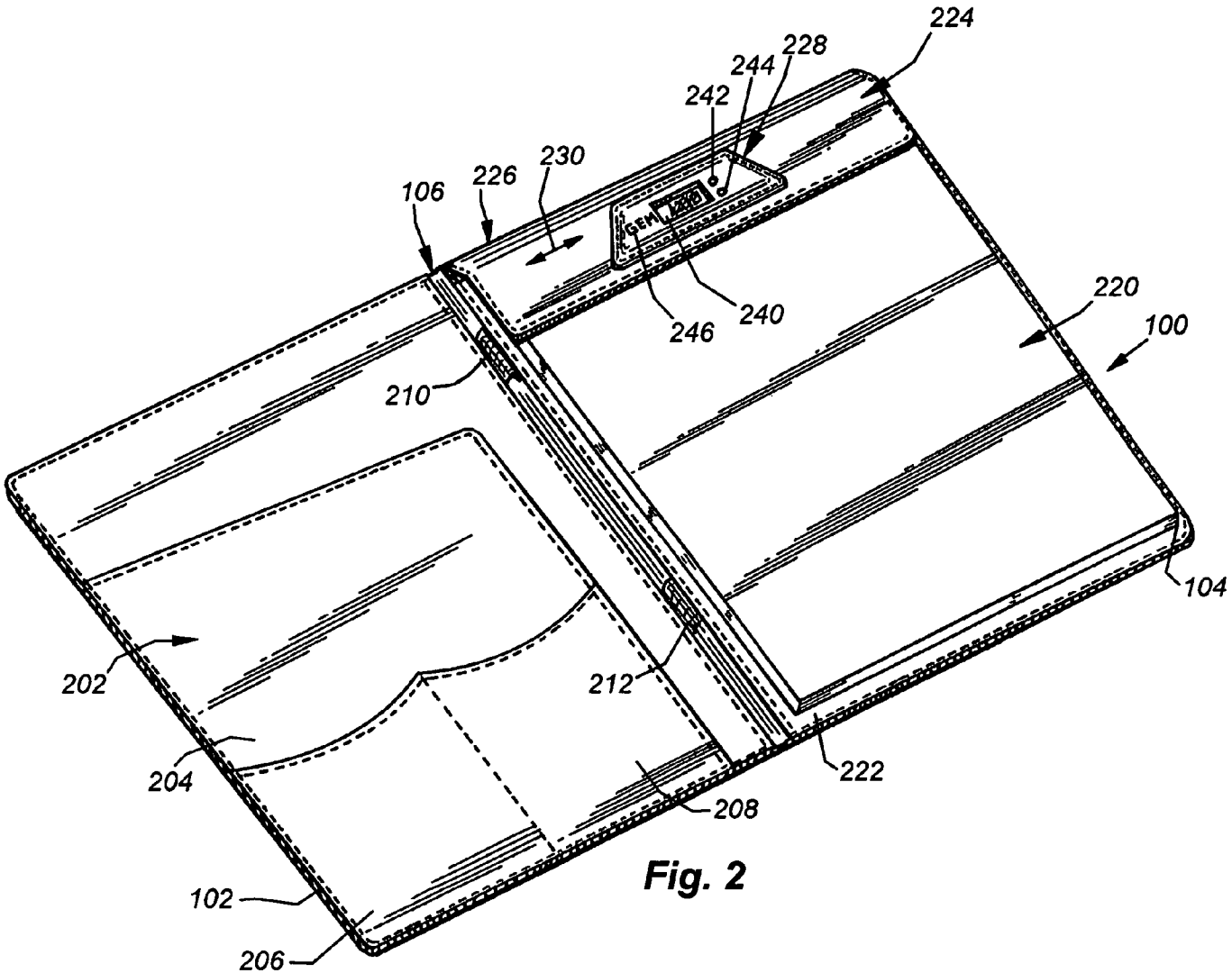
FIG. 2 is an isometric view of the notepad cover of FIG. 1 in an opened position, showing the flap with clock feature according to this invention.

FIG. 2 shows the notepad cover 100 in an opened position with the interior of the top cover 102 and bottom cover 104 each exposed. The top cover interior includes a pocket arrangement 202 that, in this example, consists of a main pocket 204 and a pair of smaller sub-pockets 206 and 208. These pockets can be used variously for holding cards, loose papers and any other relatively flat items. This arrangement of pockets is exemplary only and a variety of alternate arrangements are contemplated. Such alternate arrangements can include pockets with clear windows, clips and covers for small business accessories such as calculators. Within the interior of the spine 106 there are pen or pencil loops 210 and 212 provided. Along the interior of the bottom (or back) cover 104 is mounted a notepad 220. The notepad includes a rigid cardboard backing (see 318 in FIG. 3) that is slipped inside a large pocket 222 that is open at its top adjacent to the top flap 224 according to an embodiment of this invention. The top flap covers a bound spine (306 in FIG. 3) that holds the leaves of the notepad together along their top. The leaves can each be perforated for easy removal from the bound pad. In general, the exact arrangement of the notepad and the contents of its leaves are highly variable.

The flap 224 is attached at a seam 226 to the bottom cover. It includes a novel clock assembly 228 according to this invention. This clock assembly is centered along the width direction (double arrow 230) of the flap 224. The clock assembly's placement on the flap, as well as its size, can be varied.

The clock assembly 228 includes a central digital display window 240, a pair of set button detents or holes 242 and 244 and an optional decorative logo 246. The display is liquid crystal digital (LCD) display in the illustrative embodiment.

Figure 3:
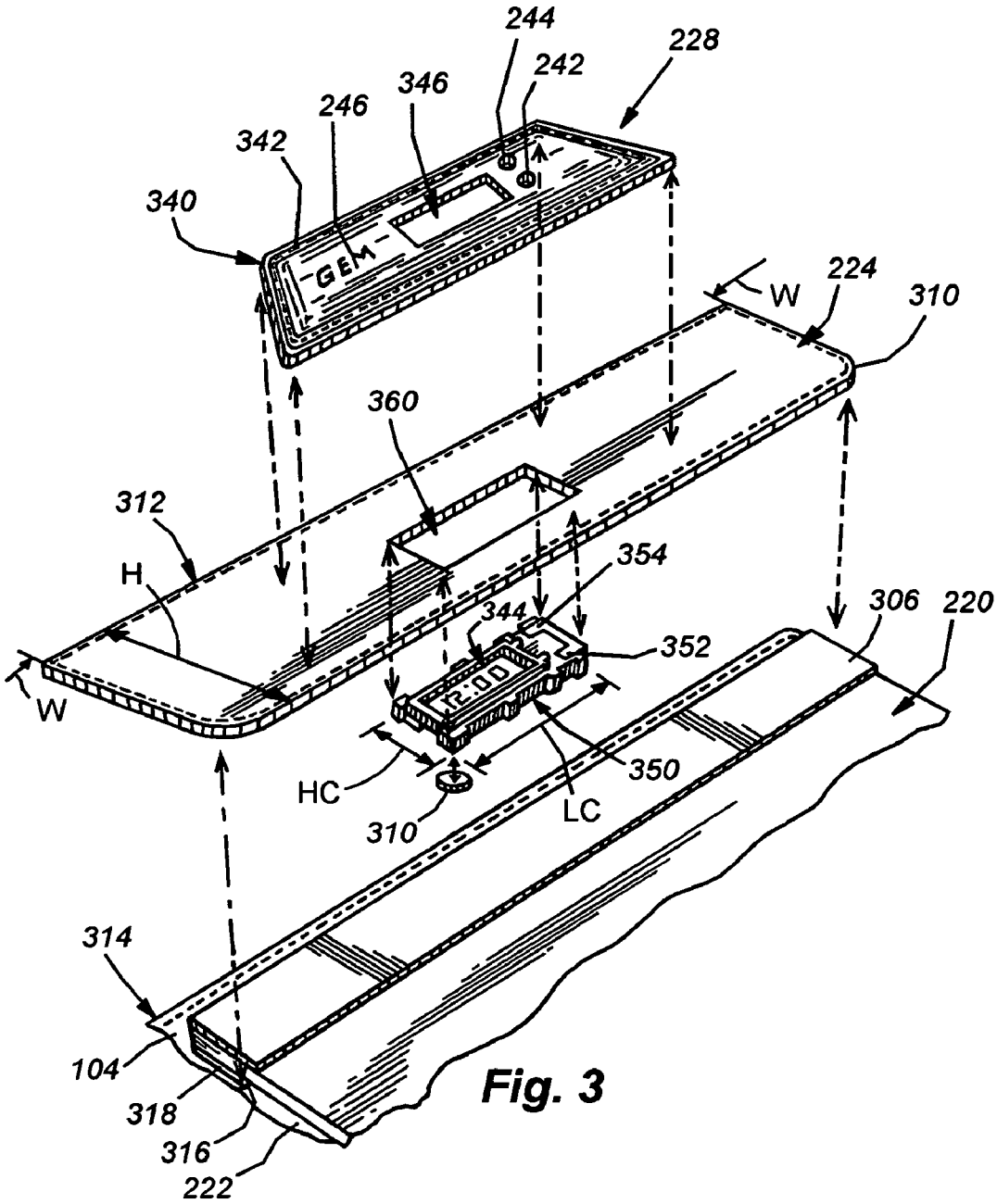
FIG. 3 is an exploded perspective view of the clock chip and flap assembly according to an illustrative embodiment of this invention.

With further reference to FIG. 3, the construction of the clock assembly 228 and flap 224 is shown in further detail. In general, the flap is sized so that its width W is slightly greater than that of the spine 306 of the notepad 220. In this manner, it fully covers the spine for an ascetically pleasing appearance. The height H of the pad is between 2 and 3 inches in an illustrative embodiment, sufficient to cover the spine 306 and extend slightly onto the leaves of the notepad. The flap 224 includes peripheral stitching 310. This stitching can be both decorative and functional, in that it may allow two pieces of material (leather, vinyl, etc.) to enclose a stiffener and/or padding within the flap. The top edge 312 of the flap is stitched to the top edge 314 of the notepad cover's back cover 104. The stitching occurs above the top edge 316 of the pocket 222 used to hold the pad's cardboard backing 318.

The joint between the flap top edge 312 and cover top edge 314 can be double-stitched for extra strength. It is generally only along the edge so that the flap can be lifted to access the spine of the notepad 220 as well as the underside of the clock assembly 228.

The clock assembly 228 includes an exterior bezel 340 that retains the clock chip 350 against outward movement away from the flap 224. In this embodiment, the bezel 340 is constructed from a soft, pliable material such as soft polyvinylchloride (PVC). It is somewhat rounded or domed in its surface profile (see for example FIG. 4), and is approximately ⅛ to 3⁄16 inch thick at its thickest point. The actual thickness is highly variable and depends, in part, upon the ability of the notepad to close over the bezel 340 without being obstructed, as well as the thickness of the clock chip contained by the bezel. Note that the bezel can be constructed from a variety of materials and in a variety of shapes. In alternate embodiments, the bezel can be integral or unitary with the flap.

In the illustrative embodiment, the bezel 340 is attached to the top surface of the flap 224 by stitching 342 and/or another mechanism, including adhesives. The height and width, as well as the outline shape of the bezel are highly variable. In general, the bezel height and width are sufficient to enclose the clock chip 350, according to the illustrative embodiment, and likewise, do not extend beyond the perimeter edges of the flap 224. The clock chip is a commercially-available unit. It is between approximately 1/16 and 1/8 inch in thickness, but the thickness is highly variable. It is approximately 1/2 to 3/4 inch in height (HC) and approximately 3/4 to 1 1/4 inch in length (LC). The clock chip includes a rectangular display window 344. A corresponding rectangular orifice 346 within the bezel 340 is sized to expose the window 344 without exposing the surrounding supporting structure or circuitry. Note that the window 344 may include a raised edge that conforms closely to the orifice 346 so as to register the clock chip accurately to the bezel during assembly, and restrict lateral movement after assembly.

The bezel 340, as noted above, includes a pair of detents (thin-walled but not-fully perforated) or through-holes 242 and 244 that are aligned over clock-setting adjustment contacts 352 and 354, respectively, on the clock chip 350. The number and location of setting/adjustment detents can be varied. In alternate embodiments, adjustment detents or holes can be omitted, and adjustment of the clock chip can be performed from the rear in a manner to be described further below. Room is also provided on the bezel 340 to include a variety of printed and/or embossed logos and designs. These logos/designs can be surface printed (pad-printed onto a flat surface for example) or can be formed/molded into the material of the bezel. Logos, such as the logo 246, can be provided on the open side of the bezel as shown or, where appropriate, on the adjustment-hole-carrying side opposite the open side.

Figure 4:
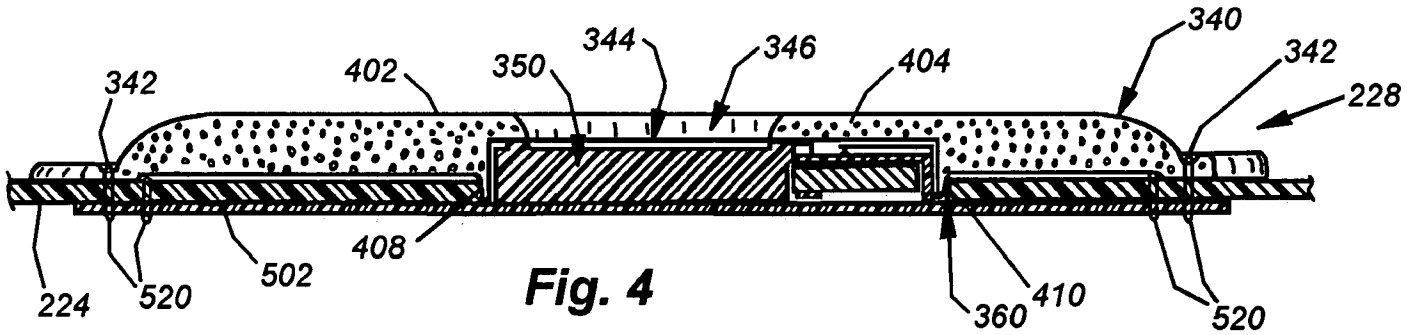
FIG. 4 is a side cross section of the clock and the flap assembly.

In this embodiment, the flap 224 also includes a rectangular orifice 360 sized to allow the clock chip 350 to pass therethrough. With further reference to FIG. 4, the assembled clock feature 228 is shown in cross section. The clock chip 350 is restrained against outward movement by bezel shoulders 402 and 404 that surround the orifice 346. The lower side of the clock resides within the hole 360 formed in the flap 224. In an alternate embodiment, the well formed by the shoulders 402 and 404 is sufficiently deep so that the entire chip can reside within the bezel 340. As such, the well 360 within the flap need not surround the entire perimeter of the clock chip 350 in certain embodiments. Note that the bezel 340 can be provided with shoulders 408 and 410 that extend into the flap well 360. These can assist in registering the bezel during assembly, and assure that it is properly aligned over the flap well 360.

Figure 5:
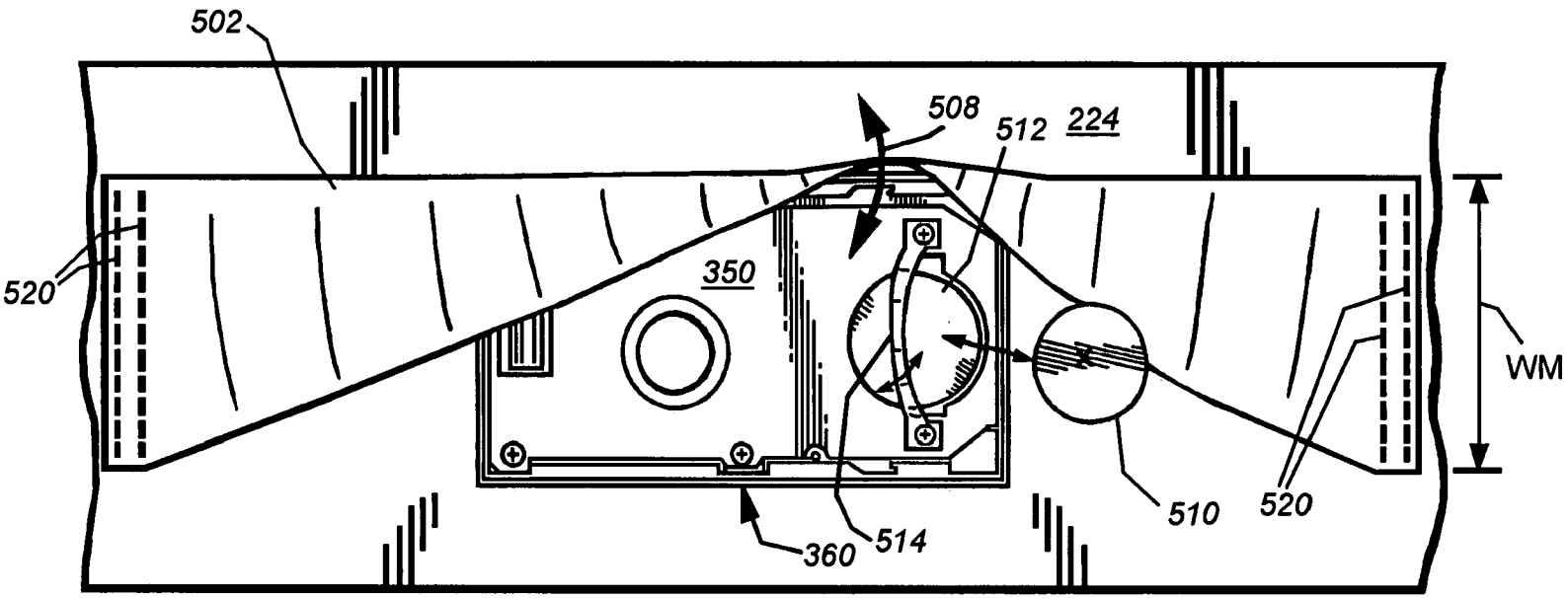
FIG. 5 is a bottom plan view of the flap showing the clock and battery compartment exposed.

With reference also to FIG. 5, the open bottom of the well 360 is covered by a strip of woven elastic material 502 according to the illustrative embodiment. The elastic material can be any acceptable woven webbing or solid elastomeric sheeting. Alternatively, the material can be non-elastic and detachable using, for example, a hook and loop fastener system. As shown, the material 502 has a width WM that is approximately equal to or greater than the width (HC) of the clock chip 350. The material 502, in one embodiment, retains the clock chip within the well 360. Where the clock chip is otherwise retained by adhesives or shoulders, then the material serves mainly to cover the base of the clock chip to prevent infiltration of dirt and contaminants. The material 502 can be displaced (double arrow 508) by stretching it away from the bottom of the flap so as to expose the bottom of the clock chip 350. In this embodiment, a battery 510, that resides within a battery well 512 can be installed into and removed from the clock chip once the material is moved aside. In an alternate embodiment, the entire clock chip can be removed to change the battery or otherwise service the unit. This is particularly useful if the battery is located on the upper side of the clock chip. In this embodiment, the battery is restrained by a band 514 that extends over the battery well 512. The material 502 is secured to the flap 224 using stitches 520. A variety of alternate attachment mechanisms including adhesives and/or staples can be used as well. Likewise, the illustrative elastic material piece 502 can be substituted with a moving door or other cover arrangement in alternate embodiments. In further embodiments, the material piece can be omitted as long as access to the battery is maintained. Of course, in a completely disposable arrangement, access to the battery may be unnecessary, wherein the well is completely sealed.

In use, the clock can be set by placing a pointed object, such as a pen, through the detents holes 242 and 244. To access the battery, the flap 224 is rotated upwardly and the material piece 586 is pulled aside to reveal the bottom of the clock. At this time, the battery 510 is removed from the bottom of the clock chip 350 and/or a new battery is placed into the well 512 at the bottom of the clock chip. To remove the pad, the flap 224 is rotated away from the spine 306 and the notepad is slid out of the pocket 222 to enable insertion of a new notepad backing into the pocket 222. When operations are complete, the flap 224 is lowered back into position overlying the spine 306 and the clock is visible with the desired time.

The foregoing has been a detailed description of illustrative embodiments of the invention. Various modifications and additions can be made without departing from the spirit and scope of this invention. For example, while a basic clock chip is shown, a clock chip having a variety of functions, including date, time and the like can be employed. Where this chip is sufficiently miniaturized, such as a mini-calculator can also be provided. Likewise, the clock chip can include an alarm and a further hole or aperture can be provided to port the alarm sound. Alternatively, an alarm can be ported through the material piece at the bottom. Also, while the clock display is a digital display in the illustrative embodiment, and more particularly, a liquid crystal digital (LCD) display, it is contemplated that the display can have a different format, such as a light-emitting diode (LED) display or even an analog display. Further, while a rectangular clock face and corresponding bezel hole is shown, the clock and bezel can have any perimeter shape including square, ovular, circular and irregular. Also, while the clock bezel is open to reveal the display face in this embodiment, it can have a secondary bezel-mounted clear window over the display, or even a movable flap/cover that obscures the display until needed. Similarly, the display can be provided with back light features for easier night viewing. Accordingly, this description is only to be taken by way of example and not to otherwise limit the scope of the invention.

What is claimed is:

1. A notepad cover having a flap for covering a spine of a note-pad comprising:

a clock mounted within the flap;

a bezel mounted on an exterior surface of the flap, the bezel including an orifice that exposes a clock display and prevents outward movement of the clock out of the flap and wherein the flap includes a well defined on an interior surface opposite the exterior surface of the flap adjacent to the orifice; and wherein the clock includes a clock chip mounted beneath the bezel within the well.

2. The notepad cover as set forth in claim 1 wherein the bezel comprises a stitched soft plastic piece mounted over the flap.

3. The notepad cover as set forth in claim 2 further comprising a cover mounted on an underside of the flap opposite a side of the flap facing the bezel that removably covers the clock chip.

4. The notepad cover as set forth in claim 3 wherein the cover comprises a piece of elastic material.

5. The notepad cover as set forth in claim 4 wherein the material piece is adapted to be moved aside to expose a battery of the clock chip for removal thereof.

6. The notepad cover as set forth in claim 5 wherein the bezel includes a detent or hole for accessing a setting button on the clock chip.

7. The notepad cover as set forth in claim 6 wherein a portion of the bezel includes space for a logo.

8. The notepad cover as set forth in claim 5 wherein the flap is attached along a top edge thereof to a top edge of a cover of the notepad cover so that the flap can be rotated away from a spine of the notepad.

9. A notepad cover having a flap for covering a spine of a notepad comprising:

a clock mounted within the flap:

a bezel mounted on an exterior surface of the flap, the bezel including an orifice that exposes a clock display and prevents outward movement of the clock out of the flap; and wherein the bezel includes a perimeter edge having stitching that is attached to the flap.

10. A notepad cover having a flap for covering a spine of a notepad comprising:

a clock mounted within the flap;

a bezel mounted on an exterior surface of the flap, the bezel including an orifice that exposes a clock display and prevents outward movement of the clock out of the flap; and wherein the flap includes a well for receiving a clock chip and wherein the bezel includes shoulders that extend into the well so as to align the bezel with respect to the well.

11. A notepad cover having a flap for covering a spine of a notepad comprising:

a clock having a display and including a clock chip that drives the display, the display being exposed through an orifice in the flap and the clock chip residing in a well along an interior surface of the flap; and a bezel mounted on an exterior surface of the flap, surrounding the orifice, the bezel preventing outward movement of the clock out of the flap.

12. The notepad cover as set forth in claim 11 further comprising a cover mounted on an underside of the flap opposite a side of the flap facing the bezel that removably covers the clock chip.

13. The notepad cover as set forth in claim 12 wherein the cover comprises a piece of elastic material.

14. The notepad cover as set forth in claim 13 wherein the material piece is adapted to be moved aside to expose a battery of the clock chip for removal thereof.

15. The notepad cover as set forth in claim 11 wherein the bezel includes a detent or hole for accessing a setting button on the clock chip.

16. The notepad cover as set forth in claim 15 wherein a portion of the bezel includes space for a logo.

17. The notepad cover as set forth in claim 11 wherein the flap is attached along a top edge thereof to a top edge of a cover of the notepad cover so that the flap can be rotated away from a spine of the notepad.

* * * * *